US007422228B2

(12) United States Patent
Cheung

(10) Patent No.: US 7,422,228 B2
(45) Date of Patent: Sep. 9, 2008

(54) SPORTS BOARD

(76) Inventor: Wah Kan Cheung, 18 Bilberry Crescent, Richmond Hill, Ontario (CA) L4S 2M4

( * ) Notice: Subject to any disclaimer, the term of this patent is extended or adjusted under 35 U.S.C. 154(b) by 419 days.

(21) Appl. No.: 11/009,176

(22) Filed: Dec. 10, 2004

(65) Prior Publication Data

US 2006/0125195 A1 Jun. 15, 2006

(51) Int. Cl.
*B62M 1/00* (2006.01)

(52) U.S. Cl. ..... 280/609; 280/610; 280/14.22; 280/27; 280/28.16; 280/845; 280/79; 280/65

(58) Field of Classification Search ..... 280/609, 280/610, 14.22, 27, 28, 18, 845, 28.16, 79, 280/65

See application file for complete search history.

(56) References Cited

U.S. PATENT DOCUMENTS

| | | | | |
|---|---|---|---|---|
| 3,378,274 | A | 4/1968 | Poppen | |
| 3,878,015 | A * | 4/1975 | Johnston | 156/222 |
| 4,533,150 | A * | 8/1985 | Hardy | 280/14.28 |
| 4,850,913 | A | 7/1989 | Szabad, Jr. | |
| 5,328,200 | A | 7/1994 | Pelizzari | |
| 6,106,345 | A * | 8/2000 | Yeh | 441/65 |
| 6,182,986 | B1 * | 2/2001 | Smith | 280/87.042 |

(Continued)

FOREIGN PATENT DOCUMENTS

CA 2 370 637 A1 7/2001

(Continued)

*Primary Examiner*—Christopher P. Ellis
*Assistant Examiner*—Cynthia F. Collado
(74) *Attorney, Agent, or Firm*—Clement Cheng

(57) ABSTRACT

The invention is directed to a sports board (15). In the preferred embodiment, the board comprises an expanded polymer foam core (16), an extruded thermoplastic polymer outer layer (20) having an inner surface (21) and an outer surface (22), an expanded polymer foam intermediate layer (19) between the core and the outer layer which is laminated to the inner surface of the outer layer, the outer surface of the outer layer being substantially planar and having at least one series (23) of longitudinally extending, parallel and alternating grooves (26) and ridges (27), the series having a width (28) and the grooves and ridges spaced across the width so as to provide from about ten to about eighty grooves per inch of the width. The grooves may be spaced so as to provide about forty-five grooves per inch of the width. The grooves may have a depth (33) of from about 0.05 mm to about 1 mm. The depth may be about 0.4 mm. The core may be polyurethane foam, polyethylene foam, polypropylene foam or polystyrene foam, the outer layer may be polyethylene or polypropylene, and the intermediate layer may be polyethylene foam or polypropylene foam. Each of the grooves may have a width (34) and the combined width of all the grooves in the series may be from about twenty percent to about eighty percent of the width of the entire series. The combined width of all the grooves in the series may be about fifty percent of the width of the series. The width of the grooves may be uniform. The core may comprise two polymer foam outer layers (51, 52), a polymer inner layer (53) between the two outer layers, the inner layer having a density greater than the two outer layers. The core inner layer and the two core outer layers may be polyethylene or polypropylene.

17 Claims, 4 Drawing Sheets

U.S. PATENT DOCUMENTS

| | | | | |
|---|---|---|---|---|
| 6,290,249 | B1 * | 9/2001 | Wolf | 280/609 |
| 6,460,868 | B2 * | 10/2002 | Madrid | 280/87.042 |
| 7,083,173 | B2 * | 8/2006 | Lehr et al. | 280/28.16 |
| 2002/0121765 | A1 | 9/2002 | Wolf | |
| 2003/0205872 | A1 | 11/2003 | Mehrmann | |

FOREIGN PATENT DOCUMENTS

| | | |
|---|---|---|
| CA | 2 427 796 A1 | 2/2003 |
| CA | 2 458 284 A1 | 2/2004 |

* cited by examiner

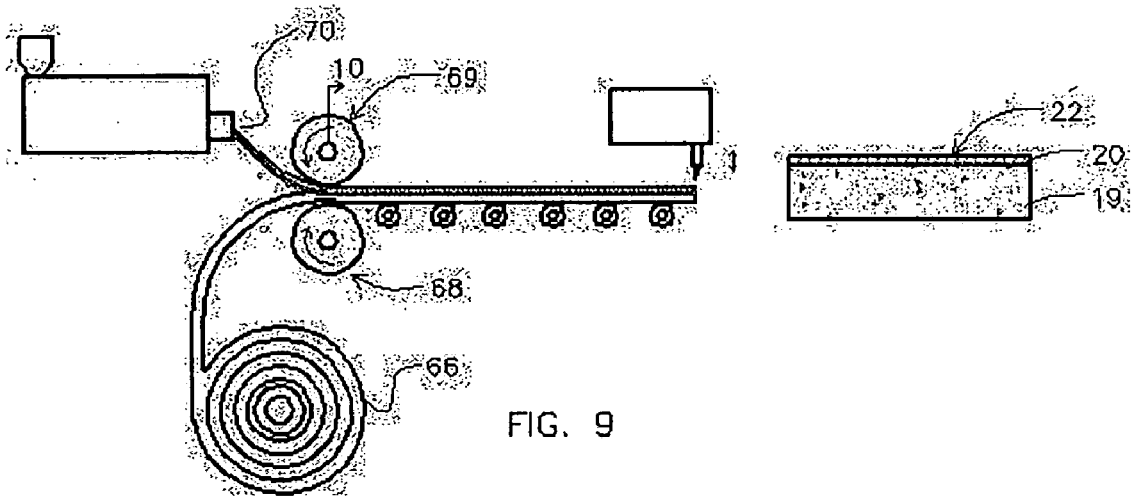
FIG. 9
FIG. 10
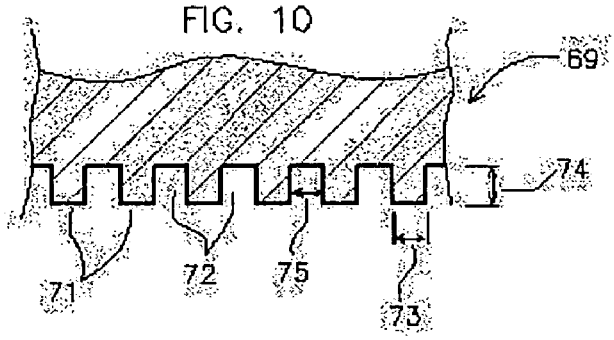
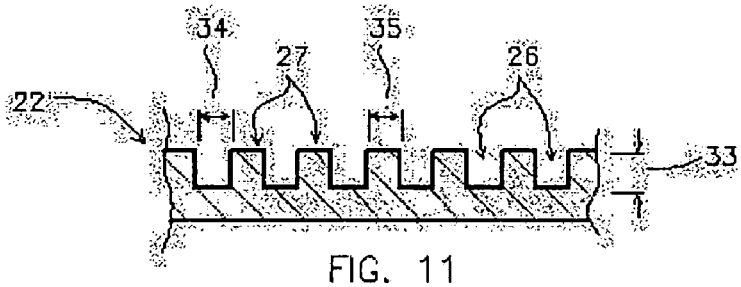
FIG. 11
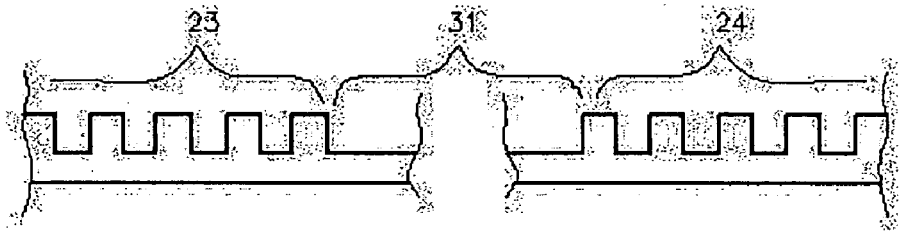
FIG. 12

SPORTS BOARD

TECHNICAL FIELD

The present invention relates to foam sports board for recreational use and, more particularly, to a laminated foam sports board with improved bottom surfacing characteristics.

BACKGROUND ART

Body boards for riding waves and other recreational sports board made of foam and other floatational material are known in the prior art. Ski boards and snow gliding boards made of hard plastic for use on snow are also known in the prior art.

For example, U.S. Pat. No. 5,328,200 discloses a ski or snow board with a scored plastic sole in which the scores are generally sinusoidal and have a width of 0.05 to 0.4 mm and a depth of 0.01 to 0.05 mm. The board disclosed in U.S. Pat. No. 5,328,200 is made from plastic and the longitudinal distance between the scores is not addressed other than to indicate that several tens of them may lie side by side over the width of the board. The scores are made either by grinding or milling.

U.S. Pat. No. 6,290,249 discloses a snow gliding apparatus with a number of channels cut into the bottom of the board. The channels do not appear to be closely spaced. The channels are cut into the bottom surface with a router or other cutting device.

However, it would beneficial to provide a foam core snow board with spaced grooves which can be cost effectively manufactured and which would have improved performance when in use.

DISCLOSURE OF THE INVENTION

With parenthetical reference to the corresponding parts, portions or surfaces of the disclosed embodiment, merely for the purposes of illustration and not by way of limitation, the present invention provides an improved sports board (15) comprising an expanded polymer foam core (16), an extruded thermoplastic polymer outer layer (20) having an inner surface (21) and an outer surface (22), an expanded polymer foam intermediate layer (19) between the core and the outer layer which is laminated to the inner surface of the outer layer, the outer surface of the outer layer being substantially planar and having at least one series (23) of longitudinally extending, parallel and alternating grooves (26) and ridges (27), the series having a width (28) and the grooves and ridges spaced across the width so as to provide from about ten to about eighty grooves per inch of the width. The grooves may be spaced so as to provide about forty-five grooves per inch of the width. The grooves may have a depth (33) of from about 0.05 mm to about 1 mm. The depth may be about 0.4 mm. The core may be polyurethane foam, polyethylene foam, polypropylene foam or polystyrene foam, the outer layer may be polyethylene or polypropylene, and the intermediate layer may be polyethylene foam or polypropylene foam. Each of the grooves may have a width (34) and the combined width of all the grooves in the series may be from about twenty percent to about eighty percent of the width of the entire series. The combined width of all the grooves in the series may be about fifty percent of the width of the series. The width of the grooves may be uniform. The core may comprise two polymer foam outer layers (51, 52), a polymer inner layer (53) between the two outer layers, the inner layer having a density greater than either of the two outer layers. The core inner layer and the two core outer layers may be polyethylene or polypropylene.

The present invention also provides an improved sports board comprising an expanded polymer foam core, an extruded thermoplastic polymer outer layer having an inner surface and an outer surface, an expanded polymer foam intermediate layer between the core and the outer layer which is laminated to the inner surface of the outer layer, the outer surface of the outer layer being substantially planar and having at least one series of longitudinally extending, parallel and alternating grooves and ridges, the series having a width and each of the grooves having a width, the combined width of all the grooves in the series being from about twenty percent to about eighty percent of the width of the series.

The present invention also provides an improved sports board comprising an expanded polymer foam core, an extruded thermoplastic polymer outer layer having an inner surface and an outer surface, an expanded polymer foam intermediate layer between the core and the outer layer which is laminated to the inner surface of the outer layer, the outer surface of the outer layer being substantially planar and having at least one series of longitudinally extending, parallel and alternating grooves and ridges, the grooves having a depth below the ridges of from about 0.05 mm to about 1 mm. The depth may be about 0.4 mm.

The present invention also provides an improved sports board (60) comprising an expanded polymer foam core (61), an extruded thermoplastic polymer outer layer (62) having an inner surface (63) and an outer surface (64), the inner surface laminated to the foam core, the outer surface of the outer layer being substantially planar and having at least one series of longitudinally extending, parallel and alternating grooves and ridges, the series having a width and the grooves and ridges spaced across the width so as to provide from about ten to about eighty grooves per inch of the width. The sports board may further comprise a second outer polymer layer (65) laminated to the foam core and the second outer layer may be polyethylene film or polypropylene film.

Accordingly, the general object of the presented invention is to provide an improved foam sports board having an extruded bottom surface with grooves that provide improved gliding properties.

Another object is to provide an improved foam based board in which the bottom surface can be formed with narrowly spaced small grooves.

Another object is to provide an improved foam board in which the bottom surface, having multiple grooves, may be laminated to one or more other foam layers of the board.

Another object is to provide a method of forming a sports board with a grooved bottom surface during extrusion.

BRIEF DESCRIPTION OF THE DRAWINGS

FIG. 9 is a schematic showing the process by which the bottom layer 20 is formed with ridges and grooves and laminated to the intermediate layer 19 shown in FIG. 5.

FIG. 10 is an enlarged partial longitudinal sectional view of the embossing roller shown in FIG. 9.

FIG. 11 is partial transverse vertical sectional view of layer 20 shown in FIG. 9.

FIG. 12 is an enlarged partial longitudinal sectional view of an alternative embodiment of the embossing roller shown in FIG. 10.

DESCRIPTION OF THE PREFERRED EMBODIMENTS

Figure 1:
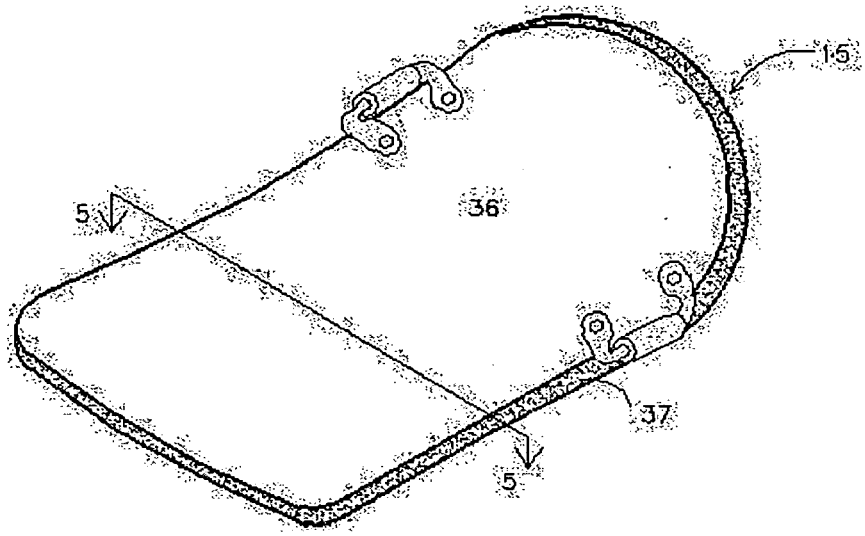
FIG. 1 is a perspective view of the improved sports board.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
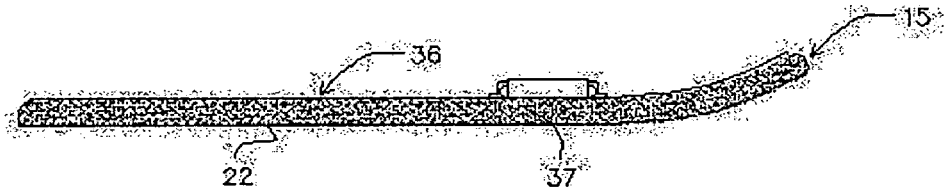
FIG. 2 is a side elevation of the sports board shown in FIG. 1.
Figure 3:
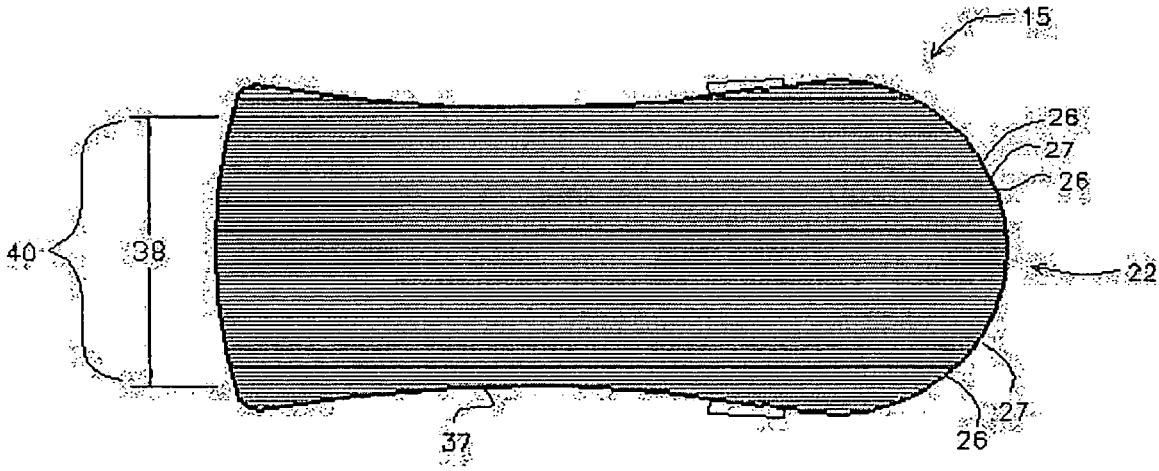
FIG. 3 is a bottom plan view of the sports board shown in FIG. 1.

Referring now to the drawings and, more particularly, to FIG. 1 thereof, this invention provides an improved sports board, the first general embodiment of which is generally indicated at 15. As shown in FIG. 1, sports board 15 is generally a flat planar body having an upturned front portion and handles on the left and right sides. As shown in FIGS. 2-3, board 15 generally includes a top surface 36 and a bottom surface 22 with an outer edge 37 therebetween. The left and right side edges of board 15 include an inwardly extending curvature that provides a slightly hour-glass shape to the board.

As shown in FIG. 3, in a first specific embodiment, the bottom surface 22 of board 15 is generally a flat planar surface that includes multiple longitudinally extending parallel grooves, severally indicated at 26, that define longitudinally extending parallel ridges, severally indicated at 27, therebetween. These longitudinally extending, parallel and alternating grooves and ridges extend the full length of bottom surface 22 of board 15. In the specific embodiment shown in FIG. 3, only a single series 40 is provided and such series extends the entire inner width 38 of board 15.

Figure 4:
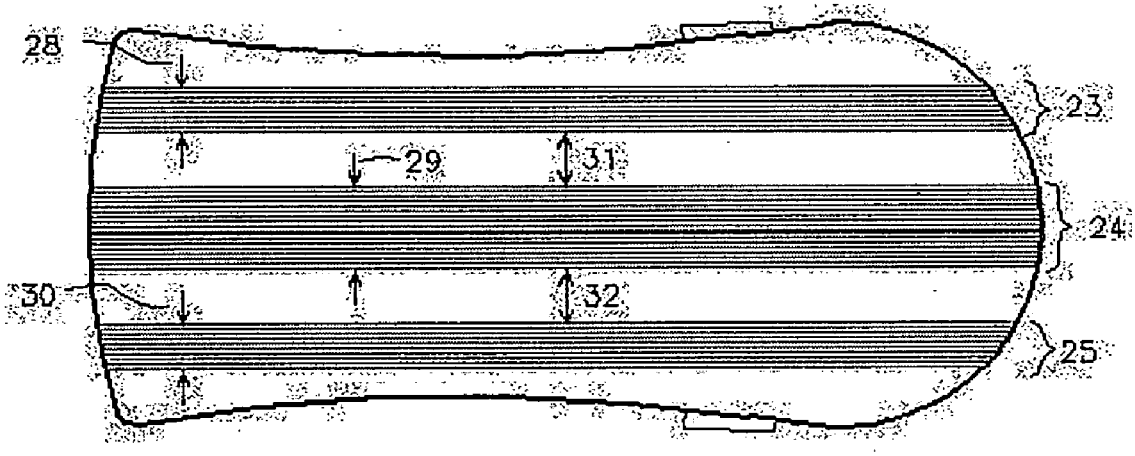
FIG. 4 is a bottom plan view of a second specific embodiment of the sports board shown in FIG. 1.

FIG. 4 shows a second specific embodiment of board 15 in which alternating grooves and ridges are provided on bottom surface 22 in three separate series 23-25. In the specific embodiment shown in FIG. 4, series 23 ranges in width 28 from about 38 mm to 115 mm, and preferably has a width 28 of about 64 mm. Series 24 has a width 29 ranging from about 50 mm to 152 mm, and preferably has a width 29 of about 115 mm. Series 25 has a width 30 ranging from about 38 mm to 115 mm, and has a preferred width of about 64 mm. The transverse distance between series 23 and 24 ranges between about 25 mm and 127 mm, and is preferably 64 mm. The distance 32 between series 24 and series 25 ranges from between about 25 mm and 127 mm, and is preferably about 64 mm.

Figure 5:
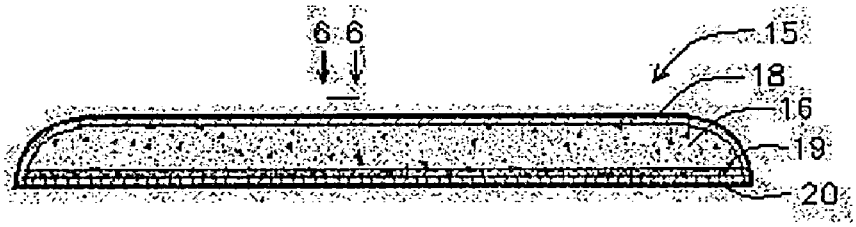
FIG. 5 is a transverse vertical sectional view of the sports board shown in FIG. 1, taken generally on line 5-5 of FIG. 1.

As shown in FIG. 5, sports board 15 is comprised of four layers laminated together. Top layer 18 is a polyethylene foam sheet. Layer 18 has a thickness of between about 2 mm and 12 mm, and preferably a thickness of about 4.5 mm. Layer 18 has a density in the range of about 4 to 10 lbs/ft$^3$, and preferably a density of about 7 lbs/ft$^3$. Alternatively, layer 18 may be a polypropylene foam sheet having a density in the range of about 2 to 6 lbs/ft$^3$, and preferably a density of about 3 lbs/ft$^3$.

Core layer 16 is polyethylene foam. Layer 16 has a thickness of between about 0.5 inches and 2 inches, and preferably a thickness of 1 inch. Layer 16 has a density in the range of about 1.6 to 4 lbs/ft$^3$, and preferably a density of about 2.2 lbs/ft$^3$. Alternatively, core layer 16 is polypropylene foam having a density in the range of about 1.5 to 3.5 lbs/ft$^3$, and preferably a density of about 1.9 lbs/ft$^3$.

As another alternative, core 16 may be polyurethane foam having a thickness between about 0.2 inches and 1.5 inches, and preferably a thickness of about 1 inch, and a density in the range of about 35 to 95 lbs/ft$^3$, and preferably a density of about 65 lbs/ft$^3$. In this embodiment, an additional layer 17 (not shown) is provided between intermediate layer 19 and the polyurethane core layer 16. This additional layer is a polyethylene foam layer that facilitates, as described later below, lamination of the polyurethane core to intermediate layer 19 and outer layer 20. Other expanded polymer foam cores, such as a polystyrene foam core, may also be employed.

Layer 19 is a polyethylene foam sheet. Intermediate layer 19 has a thickness of between about 1 mm and 5 mm, and preferably a thickness of about 3 mm. Layer 19 has a density in the range of about 4 to 8 lbs/ft$^3$, and preferably a density of about 6 lbs/ft$^3$. Alternatively, layer 19 may be polypropylene foam having a density in the range of about 2 to 6 lbs/ft$^3$, and preferably a density of about 3 lbs/ft$^3$.

Layer 20 is a polyethylene plastic sheet. Layer 20 has a thickness of between about 0.3 mm and 1.5 mm, and preferably a thickness of about 0.5 mm. Layer 20 has a density in the range of about 0.91 to 0.98 g/cm$^3$, and preferably a density of about 0.95 g/cm$^3$. Alternatively, layer 20 may be a polypropylene plastic sheet having a density in the range of about 0.86 to 0.94 g/cm$^3$, and preferably a density of about 0.9 g/cm$^3$.

Figure 6:
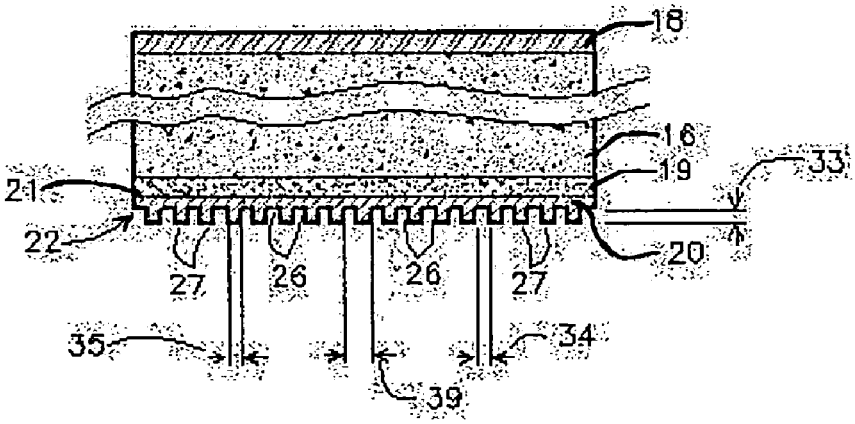
FIG. 6 is an enlarged detailed view of the indicated portion 6-6 of FIG. 5.

FIG. 6 shows an enlarged detailed view of a portion of the cross-section shown in FIG. 5. In this enlarged view, the grooved nature of bottom layer 20 is visible. As shown, the bottom surface 22 of layer 20 has a series of parallel and longitudinally extending grooves 26 with ridges 27 therebetween. The grooves and ridges are spaced close together and are small. In the preferred embodiment, the total width 39 of a groove 26 and a immediately adjacent ridge 27 ranges between about 0.32 and 2.54 mm, and preferably is about 0.56 mm. Thus, in a series (40, 23, 24 or 25) of alternating parallel grooves and ridges, there are between about 10 and 80 grooves per inch across the width (38, 28, 29, 30, respectively) of the series, and preferably there are about 45 grooves per inch.

The depth of grooves 26 may vary between about 0.05 and 1 mm, and preferably the depth 33 of each groove 26 is about 0.3 mm. Also, width 34 of each groove is between about twenty percent and eighty percent of the total width 39 of a groove 26 and an immediately adjacent ridge 27, and preferably the width 34 of groove 26 is about fifty percent of the total width 39. Thus, the preferred width 34 of groove 26 is the same as the width 35 of ridge 27. In the preferred embodiment, this width 34 and 35 is about 0.28 mm.

Figure 8:
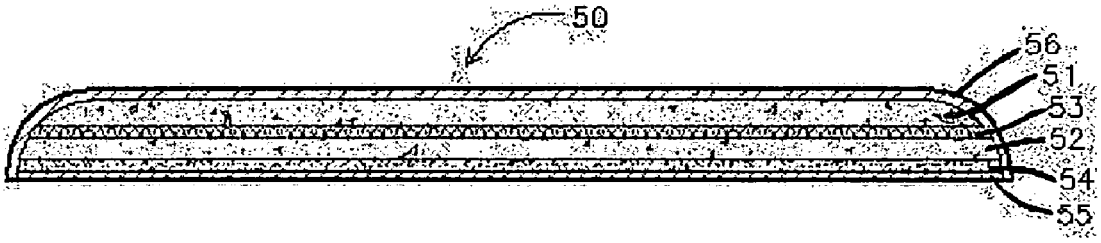
FIG. 8 is a transverse vertical sectional view of a second general alternate embodiment of the sports board in shown in FIG. 1.

FIG. 8 shows a second general embodiment 50. In this embodiment, board 50 has six laminated layers rather then four. Layer 56 is of the same structure and composition as layer 18 in the first embodiment 15. Layers 51, 53 and 52 comprise the core of board 50. Layers 51 and 52 are polyethylene foam. Each of layers 51 and 52 has a thickness of between about 3 mm and 20 mm, and preferably a thickness of about 12 mm. Each of layers 51 and 52 has a density in the range of about 1.6 to 4 lbs/ft$^3$, and preferably a density of about 2.2 lbs/ft$^3$. Alternatively, layers 51 and 52 may be polypropylene foam having a density in the range of about 1.5 to 3.5 lbs/ft$^3$, and preferably a density of about 1.9 lbs/ft$^3$.

Layer 53 is laminated between layers 51 and 52. Layer 53 is a solid polyethylene sheet that stiffens the core. Layer 53 has a thickness of between about 0.4 mm and 2 mm, and preferably a thickness of about 1 mm. Layer 53 has a density in the range of about 0.91 to 0.98 g/cm$^3$, and preferably has a density of about 0.95 g/cm$^3$. Alternatively, layer 53 may be a polypropylene having a density in the range of about 0.86 to 0.94 g/cm$^3$, and preferably a density of about 0.9 g/cm$^3$.

Layers 54 and 55 are of the same structure and composition as layers 19 and 20, respectively, of the first embodiment 15.

Figure 7:
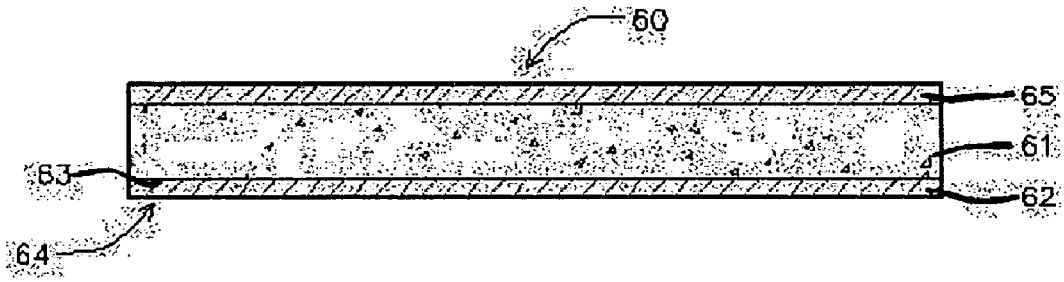
FIG. 7 is a transverse vertical sectional view of a general alternate embodiment of the sports board shown in FIG. 1.

FIG. 7 shows a third embodiment 60. In this embodiment, board 60 has three laminated layers rather than four or five. Core 61 is a polyethylene foam sheet. Core 61 has a thickness of between about 2 mm and 12 mm, and preferably a thickness of about 5 mm. Layer 61 has a density in the range of about 4 to 8 lbs/ft$^3$, and preferably a density of about 7 lbs/ft$^3$. Alternatively, core layer 61 may be a polypropylene foam sheet having a density in the range of about 2 to 6 lbs/ft$^3$, and preferably a density of about 3 lbs/ft$^3$.

Top layer 65 is polyethylene film. Layer 65 has a thickness of between about 0.02 mm and 0.15 mm, and preferably a thickness of about 0.07 mm. Layer 65 has a density in the range of about 0.91 to 0.98 g/cm$^3$, and preferably a density of about 0.95 g/cm$^3$. Alternatively, layer 65 may be polypropylene film having a density in the range of about 0.86 to 0.94 g/cm$^3$, and preferably a density of about 0.90 g/cm$^3$.

Bottom layer 62 is of the same structure and composition as layer 20 of the first embodiment 15.

Board 15 is formed in a series of steps using a specially configured roller 69, which forms the parallel and longitudinally extending grooves 26 and ridges 27 on surface 22 at the same time that layer 20 formed and laminated to intermediate layer 19. Thus, grooves 26 do not need to be ground, milled, routed or otherwise cut into the bottom surface 22. The grooves are provided in surface 22 of layer 20 as it is formed, and not in a separate stage after bottom layer 20 or board 15 is formed.

As shown in FIG. 9, layer 19 is fed from a bottom roll 66 and hot thermoplastic polymer 70 is extruded onto the top surface of layer 19 as it comes off of roll 66 and is directed between rollers 68 and 69. As shown in FIG. 10, roller 69 is engraved longitudinally with a pattern of alternating ridges 71 and grooves 72. Ridges 71 have a width 73 and a depth 74 and are separated from each other by a distance 75. The pattern is engraved parallel to the axis of rotation of roller 69 and perpendicular to the direction of rotation. Thus, as polymer 70 is extruded and passes between roller 69 and roller 68, a series of parallel and alternating ridges and grooves are impressed or thermally formed on thermoplastic polymer skin 20 as it is applied as a gliding surface on intermediate layer 19. As shown in FIGS. 10 and 11, ridges 71 on roller 69 form the grooves 26 on the outer surface 22 of layer 20 and, conversely, grooves 72 on roller 69 form the ridges 27 on the outer surface 22 of layer 20. Accordingly, the width 73 of ridges 71 and the depth 74 and width 75 of grooves 72 on roller 69 are selected to provide the desired depth 33 and width 34 of grooves 26 and width 35 of ridges 27, respectively.

Once formed, the resulting laminate 20/19 is then cut and configured to the desired shape. When using a thermoplastic polyethylene or polypropylene foam core 16, the remaining assembly is by conventional heat lamination. The remaining exposed surface of layer 19 is heat laminated to the bottom surface of layer 16 using a conventional heat lamination method. The resulting laminated foam board is then cut and configured to the desired shape and edge configuration. Finally, layer 18 is heat laminated to the top surface of layer 16, and then wrapped around to cover the sloped edge of core 16 and the straight edges of layers 19 and 20 to form a contoured side edge 37 to board 15.

If a thermoset polyurethane foam core is used with additional layer 17 employed between the polyurethane core layer 16 and intermediate layer 19, as described above, the remaining assembly is by compression molding. A compression mold having the desirable shape and contour of the foam board and having an upper portion and a lower portion is provided. Additional layer 17 is laid on the inner surface of the lower mold. Layer 18 is laid on the inner surface of the upper mold. Polyurethane resin is then injected into the mold cavity therebetween, where it reacts and foams to fill the mold cavity. With the mold cavity filled with polyurethane foam, the three layers conform to the shape of the mold. The heat generated by the chemical reaction of polyurethane foaming melts the inner surface of additional polymer foam layer 17 and foam layer 18, respectively, on contact with the hot polyurethane foam core, thereby forming a good heat bond between the core and outer layers. The molded foam laminate 17/16/18 is then trimmed for excess. The exposed surface of layer 19 of laminate 20/19 is then heat laminated to the bottom surface of layer 17 using a conventional heat lamination method to form the fully laminated foam board 15.

For board 50, layers 55 and 54 are formed and laminated using the same method used to form laminate 20/19 in board 15. The core of board 50 is formed by polymer extrusion and direct heat lamination. Hot thermoplastic polymer is extruded by a conventional polymer extruder to form polymer sheet layer 53. Polymer foam layers 51 and 52 are fed onto the top and bottom surfaces, respectively, of the hot polymer layer 53. The three layers 51, 53 and 52 are heat bonded together by passing them through a pair of nipping rollers to form core laminate 51/52/53 of board 50. The exposed surface of layer 52 is then heat laminated to the upper exposed surface of intermediate layer 54 by conventional heat lamination. The resulting laminated foam board 51/52/53/54/55 is then cut and configured to desirable board shape and edge configuration. Finally, layer 56 is heat laminated to the top exposed surface of layer 51 and then wrapped around to cover the sloped edge of core laminate 51/52/53 and the straight edges of layers 54 and 55 to form a contoured side to board 50.

With respect to board 60, top layer 65 is first heat laminated to core 61 using a conventional heat lamination method. Grooved layer 62 is then laminated to the exposed surface of core 61 of the resulting laminate 65/61 using the same process used to laminate grooved layer 20 and intermediate layer 19 for board 15, to form fully laminated board 60.

FIG. 12 shows an alternate embodiment of the longitudinal cross section of embossing roller 69. In this pattern, multiple series of alternating ridges 71 and grooves 72 are provided. In this way, the second specific embodiment of the bottom surface of board 15 shown in FIG. 4 may be provided using the same process. Numerous and differently patterned rollers 69 may be interchangeably used depending on the desired number of series of grooves and ridges and depending also on the desired dimensions of those grooves and ridges.

The present invention contemplates that many changes and modifications may be made. Therefore, the while the presently-preferred form of the improved sports board has been shown and described, and several modifications thereof discussed, persons skilled in this art will readily appreciate that various additional changes and modifications may be made without departing from the spirit of the invention, as defined and differentiated by the following claims.

What is claimed is:

1. A snow sled board comprising:

an expanded polymer foam core;

an extruded thermoplastic polymer outer layer having an inner surface and an outer surface;

an expanded polymer foam intermediate layer between said core and said outer layer which is laminated to said inner surface of said outer layer;

said outer surface of said outer layer being substantially planar and having at least one series of longitudinally extending, parallel and alternating grooves and ridges;

said series having a width and said grooves and ridges spaced across said width so as to provide from about ten to about eighty grooves per inch of said width, wherein said grooves have a depth of from about 0.05 mm to about 1 mm, wherein said core is selected from a group consisting of polyurethane foam, polyethylene foam, polypropylene foam or polystyrene foam, wherein said outer layer is selected from a group consisting of polyethylene or polypropylene, wherein said intermediate layer is selected from a group consisting of polyethylene foam or polypropylene foam, wherein said core has a density less than the density of said intermediate layer.

2. The snow sled board of claim 1, wherein said grooves are spaced so as to provide about forty-five grooves per inch of said width.

3. The snow sled board of claim 1, wherein said grooves have a depth of about 0.4 mm.

4. The snow sled board of claim 1, wherein each of said grooves has a width and the combined width of all of said grooves in said series is from about twenty percent to about eighty percent of said width of said series.

5. The snow sled board of claim 1, wherein each of said grooves has a width and wherein said combined width of all of said grooves in said series is about fifty percent of said width of said series.

6. The snow sled board of claim 1, wherein said intermediate layer has a thickness of between about 1 mm and 5 mm, and has a density in the range of about 4 to 8 lbs/ft$^3$.

7. A snow sled board comprising:

an expanded polymer foam core;

an extruded thermoplastic polymer outer layer having an inner surface and an outer surface;

an expanded polymer foam intermediate layer between said core and said outer layer which is laminated to said inner surface of said outer layer;

said outer surface of said outer layer being substantially planar and having at least one series of longitudinally extending, parallel and alternating grooves and ridges;

said series having a width and said grooves and ridges spaced across said width so as to provide from about ten to about eighty grooves per inch of said width, wherein said grooves have a depth of from about 0.05 mm to about 1 mm, wherein said core is selected from a group consisting of polyurethane foam, polyethylene foam, polypropylene foam or polystyrene foam, wherein said outer layer is selected from a group consisting of polyethylene or polypropylene, wherein said intermediate layer is selected from a group consisting of polyethylene foam or polypropylene foam, wherein said core has a density less than the density of said intermediate layer;

each of said grooves having a width, wherein the combined width of all of said grooves in said series is about between twenty percent to eighty percent of said width of said series.

8. The snow sled board of claim 7, wherein said grooves are spaced so as to provide about forty-five grooves per inch of said width.

9. The snow sled board of claim 7, wherein said grooves have a depth of about 0.4 mm.

10. The snow sled board of claim 7, wherein each of said grooves has a width and wherein said combined width of all of said grooves in said series is about fifty percent of said width of said series.

11. The snow sled board of claim 7, wherein said intermediate layer has a thickness of between about 1 mm and 5 mm. and has a density in the range of about 4 to 8 lbs/ft$^3$.

12. A snow sled board comprising:

an expanded polymer foam core;

an extruded thermoplastic polymer outer layer having an inner surface and an outer surface;

an expanded polymer foam intermediate layer between said core and said outer layer which is laminated to said inner surface of said outer layer;

said outer surface of said outer layer being substantially planar and having at least one series of longitudinally extending, parallel and alternating grooves and ridges;

said series having a width and said grooves and ridges spaced across said width so as to provide from about ten to about eighty grooves per inch of said width, wherein each of the ridges have a protruding square corner profile and wherein each of the grooves have a square corner profile so that a repeating square corner pattern extends across the bottom of the board.

13. The snow sled board of claim 12, wherein said grooves are spaced so as to provide about forty-five grooves per inch of said width.

14. The snow sled board of claim 12, wherein said grooves have a depth of about 0.4 mm.

15. The snow sled board of claim 12, wherein each of said grooves has a width and the combined width of all of said grooves in said series is from about twenty percent to about eighty percent of said width of said series.

16. The snow sled board of claim 12, wherein each of said grooves has a width and wherein said combined width of all of said grooves in said series is about fifty percent of said width of said series.

17. The snow sled board of claim 12, wherein said intermediate layer has a thickness of between about 1 mm and 5 mm. and has a density in the range of about 4 to 8 lbs/ft$^3$.

* * * * *